US005078292A

United States Patent [19]

Cremer

[11] Patent Number: 5,078,292

[45] Date of Patent: Jan. 7, 1992

[54] TAKE-APART PLASTIC BOTTLE CARRIER

[75] Inventor: Peter Cremer, Dortmund, Fed. Rep. of Germany

[73] Assignee: Split-Box Patentverwertung KG, Dortmund, Fed. Rep. of Germany

[21] Appl. No.: 623,939

[22] PCT Filed: Mar. 28, 1990

[86] PCT No.: PCT/DE90/00249

§ 371 Date: Dec. 10, 1990

§ 102(e) Date: Dec. 10, 1990

[87] PCT Pub. No.: WO90/12739

PCT Pub. Date: Nov. 1, 1990

[30] Foreign Application Priority Data

Apr. 14, 1989 [DE] Fed. Rep. of Germany ..... 3912321

[51] Int. Cl.[5] ..... B65D 6/04; B65D 25/04; B65D 25/28

[52] U.S. Cl. ..... 220/23.4; 206/427

[58] Field of Search ..... 220/23.4; 206/427

[56] References Cited

U.S. PATENT DOCUMENTS 4,387,824 6/1983 Wefers ..... 220/23.4

4,790,443 12/1988 Auer ..... 220/23.4

FOREIGN PATENT DOCUMENTS 7923328 11/1979 Fed. Rep. of Germany .

*Primary Examiner*—William I. Price

*Attorney, Agent, or Firm*—Max Fogiel

[57] ABSTRACT

A divisible bottle crate separable into two components. The components are fastened together with tongue and groove connections. The connections are prevented from accidentally separating by a locking mechanism consisting of handles mounted and pivoted on one component and having an end thereof receivable in the other component in a locking relationship.

5 Claims, 3 Drawing Sheets

G'
G
G'
G
F
E
11'
113
121
1191'
116
117/118
121
116
1191
111
119
112
119
112
117/118
1192
1191
121
1111
1191'
111
11
113
114
114
II
D

TAKE-APART PLASTIC BOTTLE CARRIER

BACKGROUND OF THE INVENTION

Bottle carriers, especially for keeping beer, mineral water, juices, and soft drinks, that can be disassembled into two components and reassembled again are easier to cope with than those that do not come apart and are accordingly being increasingly employed. Prerequisite to the utility of take-apart bottle carriers is that the assembled carrier must not only be rigid but also resist coming apart by accident. There are various approaches to assembling a carrier out of its components. The approach followed by the present invention involves the type of take-apart bottle carrier with components that are assembled in accordance with the tongue-and-groove principle. This design is already addressed in German GM 7 923 328, which does not, however, disclose a means of adequately securing the assembled components together. The insecure attachment of the components could lead to an unintended and undesired separation that would be bad for business, and this particular carrier has accordingly never been marketed.

SUMMARY OF THE INVENTION

With the aforesaid state of the art as a point of departure, the object of the present invention is to improve the generic take-apart bottle carrier, which is assembled in accordance with the tongue-and-groove principle, and prevent the components that comprise it from coming apart unintendedly.

With the relatively simple approach of assembly in accordance with the tongue-and-groove principle as a point of departure, the assembly of the components into a complete carrier is accordingly ensured in a way that will reliably prevent the carrier from coming apart into its components. A take-apart filter assembled in accordance with the tongue-and-groove principle can accordingly now be marketed as desired.

BRIEF DESCRIPTION OF THE DRAWINGS

One embodiment of the invention will now be specified with reference to the drawing, wherein.

DESCRIPTION OF THE PREFERRED EMBODIMENTS

Figure 1:
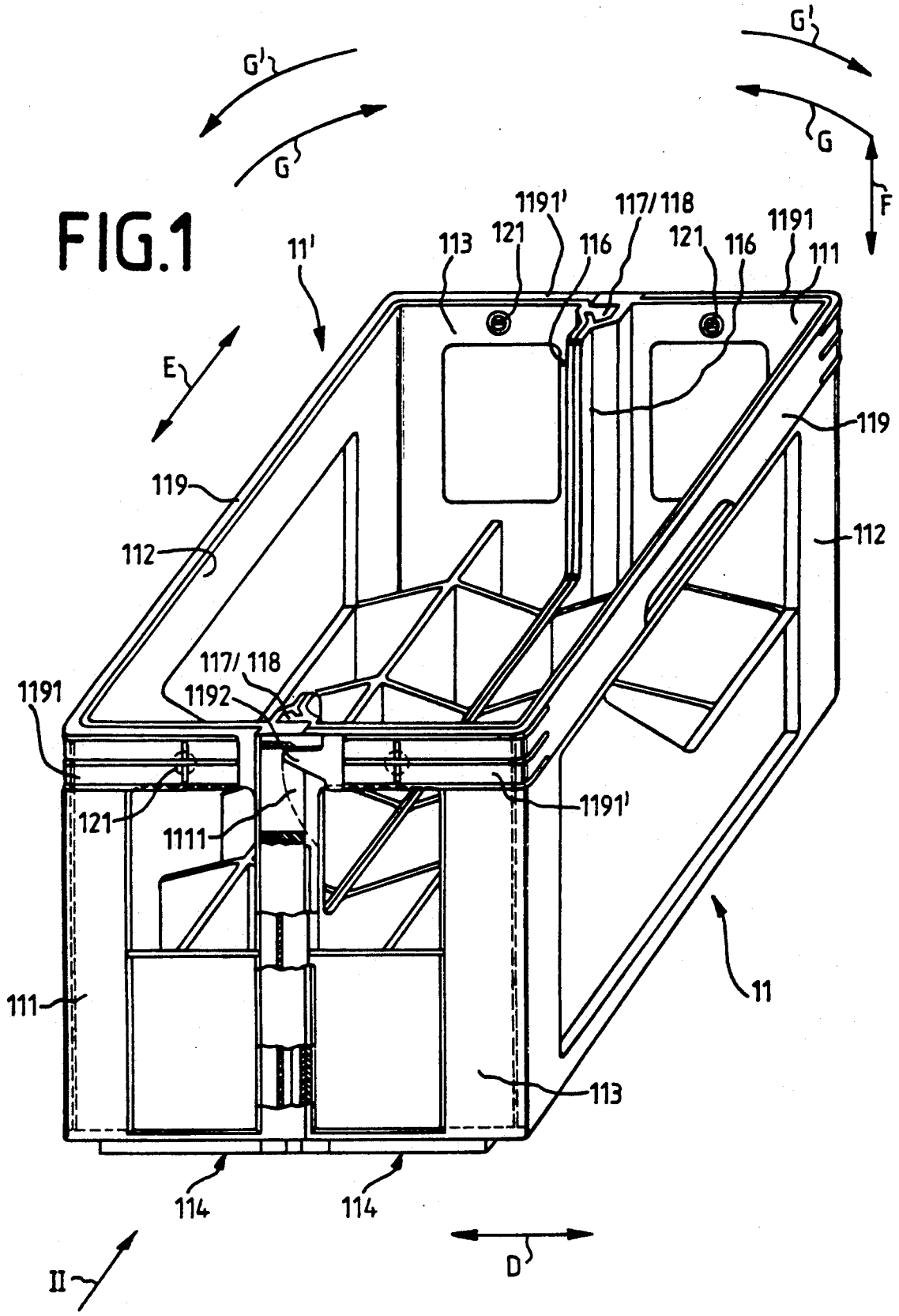
FIG. 1 is a simplified illustration of the novel take-apart bottle carrier.

The carrier consists of identical components 11 and 11', with walls 111, 112, and 113, a bottom 114, and a partition 116. Walls 111, 112, and 113 and usually bottom 114 and partition 116 are provided with the conventional recesses and perforations. Components 11 and 11' are also divided in a known way into several compartments, each accommodating one bottle.

The transition between the partition 116 and the wall 111 in each component 11 and 11' is provided with a continuous undercut groove 117 that extends the whole height of the carrier, and the transition between partition 116 and the wall 113 opposite wall 111 is provided with a tongue 118 that extends the whole height of the carrier and beyond the partition and matches the cross-section of the groove. Once one component 11 or 11' has been rotated 180° in relation to the other and the two have been assembled into a carrier, tongues 118 will fit into groove 117, resulting in an interlocking connection that will prevent the components from coming apart again in the direction indicated by double-headed arrows D and E in FIG. 1. It will, however, still be possible to separate components 11 and 11' and disassemble the carrier by sliding them apart in the direction indicated by double-headed arrow F in FIG. 1.

Also comprising components 11 and 11' are shackle-type carrying handles 119, which are articulated to walls 111 and 113 at points 121 and can be pivoted out of the position illustrated in FIG. 1 in the direction indicated by arrow G and into the carrying position. The upper edge of the components is designed to prevent handles 119 from projecting beyond walls 111 to 113 while they are pivoted back against the components (in the direction indicated by arrow G' in FIG. 1).

Figure 2:
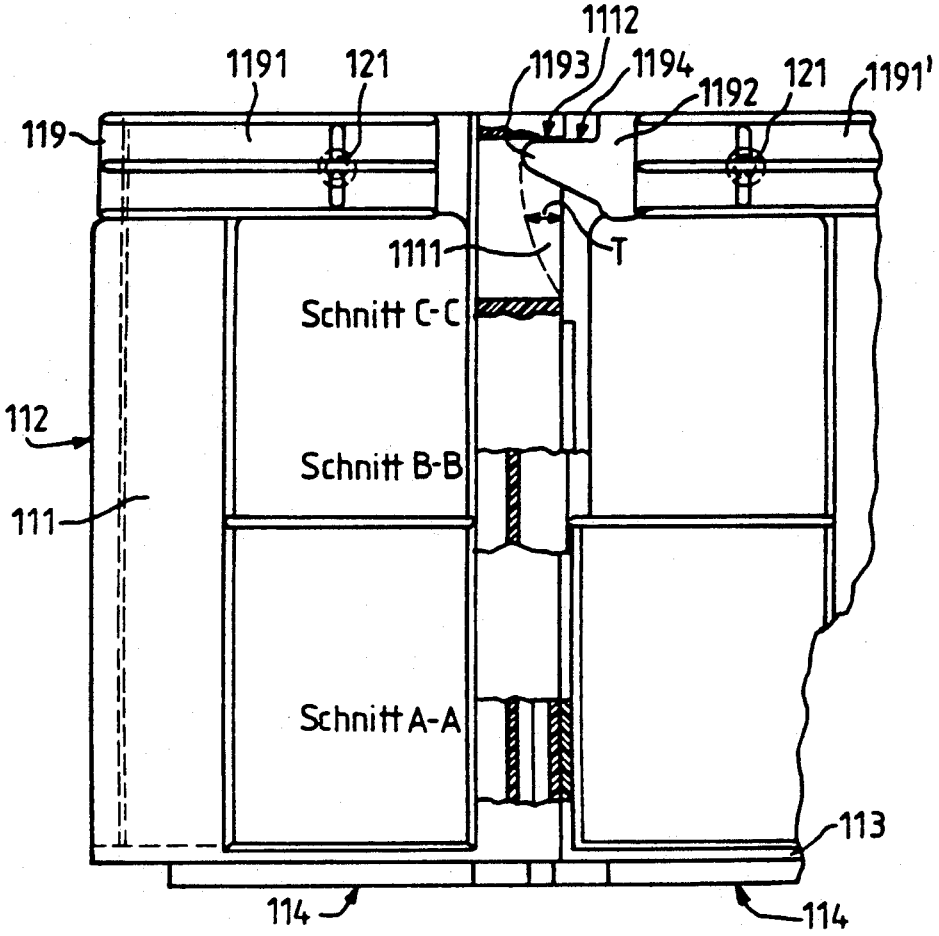
FIG. 2 is a truncated and partly X-ray view of the carrier in the direction indicated by arrow II in FIG. 1.
Figure 3:
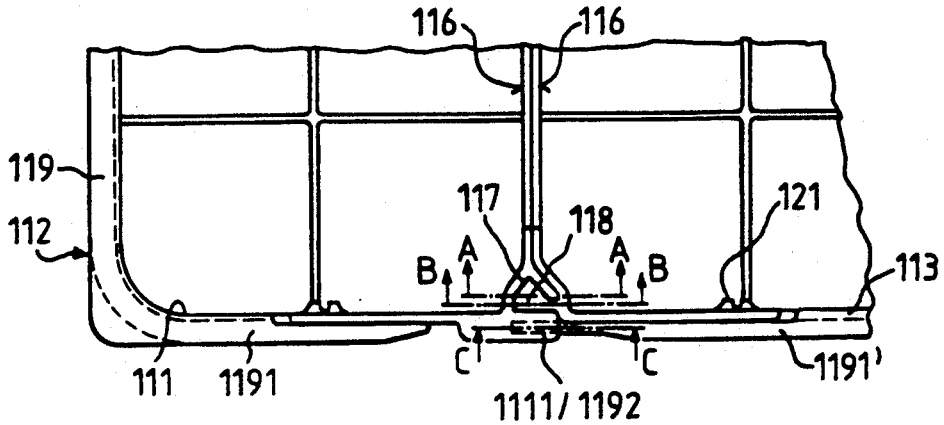
FIG. 3 is a truncated top view of the carrier.

To prevent unintended separation of the components 11 and 11' of the assembled carrier by displacement of the components against each other in the direction indicated by arrow F in FIG. 1, the section 1191' of handle 119 that is articulated to wall 113 is provided with an extension 1192 that tapers in toward its free end 1193 and projects beyond partition 116 when the handle is folded down against the component, and the wall 111 that faces the wall 113 in components 11 and 11' is provided with a recess 1111 that extends from the point of contact and constitutes an accommodation for the extension 1192 to fit into when the section 1191' of handle without the extension is flush with component 11 or 11'. Accommodation 1111 has an upper limit 1112 that the recessed section 1194 of the extension 1192 pivoted into the accommodation comes to rest against (cf. FIG. 2 in particular), and its depth T increases steadily, beginning with the area of contact between the extension 1192 pivoting into accommodation 1111 and the contact surface of the folded-in component 11 or 11' in accordance with the contour of the face of extension 1192 as the pivoting continues, to ensure that, as extension 1192 comes to rest against the upper limit 1112 of accommodation 1111, and especially its bottom, it will attain a seating between the extension and the component with the accommodation that the extension has pivoted into. This approach will also prevent unintended separation of the components 11 and 11' assembled into a carrier by displacement of the components in the direction indicated by double-headed arrow F in FIG. 1.

Figure 4:
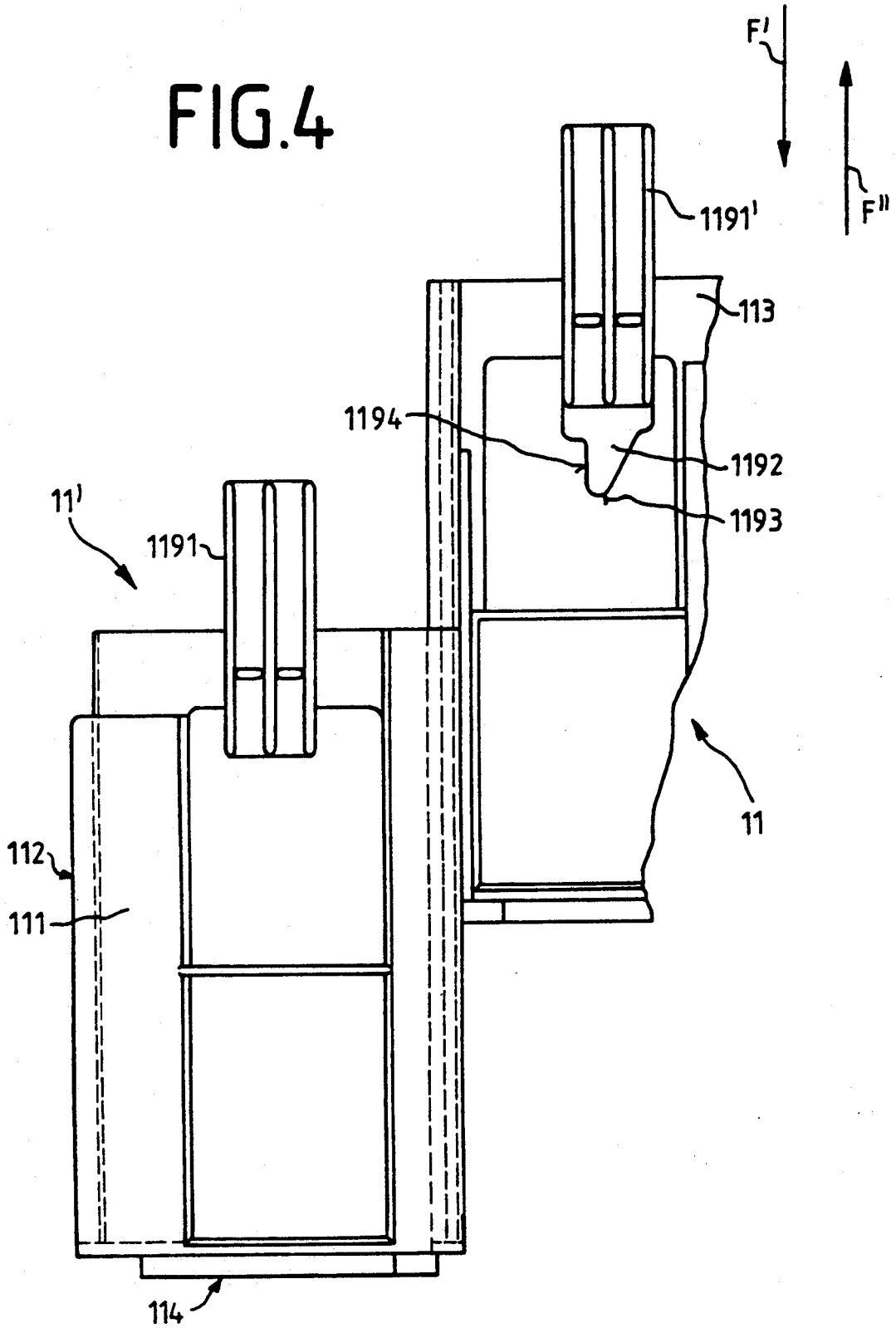
FIG. 4 is a view similar to that in FIG. 2 and representing the carrier in the process of being disassembled.

How the take-apart bottle carrier is operated will now be described. The separate components 11 and 11' are positioned together one above the other with handles 119 pivoted into the carrying position in the direction indicated by arrow G in FIG. 1 and with the contact areas, the areas with the tongues 118 and grooves 117, in alignment. The upper component is then lowered (in the direction indicated by arrow F' in FIG. 4), with its tongue 118 entering the groove 117 in the lower component and the tongue 118 in the lower component entering the groove 117 in the upper component. Once the upper component has been completely lowered, handles 119 are pivoted back (in the direction indicated by arrow G' in FIG. 1). The extension 1192 on each section enters the matching recess 1111 in the other component, establishing an additional connection that is both positive and non-positive. The bottle carrier is now completely assembled and can be managed like a single-piece carrier. It can be disassembled into components 11 and 11' again by pivoting handles 119 back into the carrying position (in the direction indicated by arrow G in FIG. 1) and sliding one component up along the other in the direction indicated by arrow F" in FIG. 4 until the tongue-and-groove joint between the two components is disestablished.

I claim:

1. A two-part plastic bottle carrier with a separation parallel to an outside wall of said carrier, comprising:

partitions for demarcating components in said carrier;

interlocking connectors at transitions between said partitions and adjacent areas of said partitions; shackle-like handles pivoted to narrow sides of said components and pivoting downward against said component; said connectors comprising a tongue at one corner; said connectors comprising a vertical groove at another corner for receiving said tongue; said handles having a section mounted outside of said components and having an extension tapering towards an end of said section and entering a recess in an impacting wall of another component when said handles are pivoted down against said component and project beyond said partitions for as long as said handles remain pivoted down against said component.

2. A two-part plastic bottle carrier as defined in claim 1, wherein said recess entered by said extension of said section has a curvature matching an end of said extension when said handles are pivoted with an upper limit passed through by said extension when said handles are completely pivoted against said component.

3. A two-part plastic bottle carrier as defined in claim 2, wherein said recess entered by said extension ends remote from an upper edge of said carrier and said extension is correspondingly recessed.

4. A two-part plastic bottle carrier as defined in claim 1, wherein said recess entered by said extension has a rear wall fitting tightly against said extension for as long as said handles remain completely pivoted down against said component and project beyond said partition.

5. A two-part plastic bottle carrier with a separation parallel to an outside wall of said carrier, comprising:

partitions for demarcating components in said carrier;

interlocking connectors at transitions between said partitions and adjacent areas of said partitions; shackle-like handles pivoted to narrow sides of said components and pivoting downward against said component; said connectors comprising a tongue at one corner; said connectors comprising a vertical groove at another corner for receiving said tongue; said handles having a section mounted outside of said components and having an extension tapering towards an end of said section and entering a recess in an impacting wall of another component when said handles are pivoted down against said component and project beyond said partitions for as long as said handles remain pivoted down against said component; said recess entered by said extension of said section having a curvature matching an end of said extension when said handles are pivoted with an upper limit passed through by said extension when said handles are completely pivoted against said components; said recess entered by said extension ending remote from an upper edge of said carrier, said extension being correspondingly recessed; said recess having a rear wall fitting tightly against said extension for as long as said handles remain completely pivoted down against said component and project beyond said partition.

* * * * *